US008696330B2

(12) United States Patent
Ohligschlaeger et al.

(10) Patent No.: US 8,696,330 B2
(45) Date of Patent: Apr. 15, 2014

(54) RECIPROCATING PISTON PUMP

(75) Inventors: Olaf Ohligschlaeger, Gruenebach (DE); Axel Mueller, Siegen (DE); Michael Mueller, Hennef (DE); Andreas Monzen, Neuwied (DE); Stefan Quast, Kirchen (DE); Bernd Koehler, Herdorf (DE); Michael Feckler, Herdorf (DE)

(73) Assignee: Thomas Magnete GmbH, Herdorf (DE)

( * ) Notice: Subject to any disclaimer, the term of this patent is extended or adjusted under 35 U.S.C. 154(b) by 478 days.

(21) Appl. No.: 12/611,442

(22) Filed: Nov. 3, 2009

(65) Prior Publication Data

US 2010/0111728 A1 May 6, 2010

(30) Foreign Application Priority Data

Nov. 3, 2008 (DE) ..... 10 2008 055 609

(51) Int. Cl.
*F04B 17/04* (2006.01)

(52) U.S. Cl.
USPC ..... 417/416; 417/555.1; 417/570; 137/539; 137/533.11; 251/359

(58) Field of Classification Search
USPC ..... 417/415, 416, 555.1, 570, 417; 137/539, 539.5, 533.11, 533.15, 514; 251/358, 359, 363
See application file for complete search history.

(56) References Cited

U.S. PATENT DOCUMENTS

| | | | | |
|---|---|---|---|---|
| 3,672,396 | A * | 6/1972 | Pauliukonis | 137/512 |
| 3,786,729 | A | 1/1974 | Rizzone | |
| 4,314,797 | A * | 2/1982 | Gerwin | 417/491 |
| 5,472,323 | A | 12/1995 | Hirabayashi et al. | |
| 5,749,394 | A * | 5/1998 | Boehmer et al. | 137/533.15 |
| 6,241,491 | B1 * | 6/2001 | Kuther | 417/553 |
| 6,948,521 | B2 * | 9/2005 | Fukano | 137/515.5 |
| 7,210,494 | B2 | 5/2007 | Ott | |
| 7,413,415 | B2 | 8/2008 | Buzzi | |
| 7,621,726 | B2 * | 11/2009 | Bachner et al. | 417/501 |
| 2005/0079072 | A1 * | 4/2005 | Petit | 417/415 |
| 2005/0158192 | A1 * | 7/2005 | Bachner et al. | 417/415 |
| 2007/0020123 | A1 | 1/2007 | Meyer et al. | |
| 2007/0145314 | A1 | 6/2007 | Hillesheim | |
| 2008/0014103 | A1 * | 1/2008 | Cooke | 417/410.1 |
| 2008/0213106 | A1 | 9/2008 | Schmidt et al. | |
| 2008/0314238 | A1 * | 12/2008 | Neuner | 92/143 |
| 2009/0068039 | A1 | 3/2009 | Alaze | |

FOREIGN PATENT DOCUMENTS

| | | | | |
|---|---|---|---|---|
| DE | 18 57 732 | U | 8/1962 | |
| DE | 3934494 | A1 * | 4/1990 | F04B 17/04 |
| DE | 93 12 752 | U | 12/1993 | |
| DE | 9312752 | U1 * | 2/1994 | F04B 17/04 |
| DE | 4413714 | C1 | 4/1995 | |
| DE | 200 19 406 | U1 | 1/2001 | |

(Continued)

*Primary Examiner* — Devon Kramer
*Assistant Examiner* — Thomas Fink
(74) *Attorney, Agent, or Firm* — Eschweiler & Associates, LLC

(57) ABSTRACT

The invention relates to a reciprocating piston pump for delivering a liquid. The pump includes a solenoid with an actuator and an outlet port. A check valve with a seat body is assigned to the outlet port for keeping a return flow of the liquid out of the reciprocating piston pump. The seat body bears an impact damping face at a front face facing away from a valve seat of the check valve, and the valve seat of the check valve and the impact damping face are made from the same elastomer material.

22 Claims, 7 Drawing Sheets

(56) References Cited

FOREIGN PATENT DOCUMENTS

| | | | | |
|---|---|---|---|---|
| DE | 10132959 | A1 * | 1/2003 | ..... F23K 5/04 |
| DE | 10241449 | A1 | 3/2004 | |
| DE | 102004011050 | A1 | 9/2005 | |
| DE | 21 25 163 | A1 | 12/2009 | |
| EP | 1748188 | A1 * | 1/2007 | |
| WO | 2004040135 | A1 | 5/2004 | |
| WO | 2007014696 | A1 | 2/2007 | |
| WO | 2007065566 | A1 | 6/2007 | |
| WO | 2007124873 | A1 | 11/2007 | |
| WO | WO 2007124873 | A1 * | 11/2007 | |
| WO | 2008061718 | A1 | 5/2008 | |

* cited by examiner

RECIPROCATING PISTON PUMP

RELATED APPLICATION

This application claims priority to German Patent application number 10 2008 055 609.2, filed on Nov. 3, 2008, the entire disclosure of which is incorporated by reference herein.

BACKGROUND OF THE INVENTION

The invention relates to a reciprocating piston pump for delivering a liquid, according to the preamble of the independent claim.

EP 1 748 188 A1 shows a reciprocating piston pump for delivering liquid fuel, comprising a solenoid having a coil arranged in a coil carrier. Arranged at an inlet-side end-face opening of the coil carrier is a core flange, which is partially enclosed by the coil carrier. A suction valve seat body, adjoining which is an inlet connection with an inlet port, which is sealed off from the core flange and in which a filter is arranged, is inserted against an internal step of the core flange. A further core part of flange-like design is inserted into the coil carrier at the outlet-side end-face opening of the coil carrier. An actuator, which comprises an armature piston and a piston rod, is axially guided inside the core part in an area still enclosed by the coil, the piston rod being securely connected to the armature piston by a pressed connection. The piston rod is axially guided in a guide bore of a metering cylinder, which is in turn again fixed to an inward-facing step of the flange-like core part. A seat body, which merges into a cylindrical tubular section and into which an outlet port is inserted and sealed off, is inserted from the side opposite the piston rod, the tubular section being screwed into an end thread of the core part. A valve spring biasing a closing element in the form of a ball towards a tapered valve seat is braced against an end face of the outlet port inserted into the tubular section, wherein the valve seat and the closing element define a linear contact. An impact damper, which is intended to damp the stroke movements of the piston rod, is inserted into the guide bore on the side of the guide bore facing the valve seat. The metering cylinder has two radial bores, which ensure a fluid connection between the guide bore of the metering cylinder and a pump chamber located outside the metering cylinder and enclosed by the flange-like core part. With no current passing through the coil, the armature piston is prestressed towards the outlet port by a helical coil spring, which is braced against the suction valve seat body. When a current passes through the coil, the armature piston is shifted towards the inlet port, wherein the return stroke ensued under the prestressing of the helical coil spring expells the liquid from the delivery chamber. An end-face impact damper is also provided at the end face of the armature piston remote from the piston rod, in order to damp impacts against the suction valve seat body. A draw back of the known reciprocating piston pump are the many parts and the numerous sealing points required, which are continuously shaken by the pump movements and therefore have a tendency to leak, especially as the pump warms up, leading to different rates of thermal expansion of the various materials. Inserting the impact dampers into the guide bore is intricate, as is pressing the metering cylinder into the core part, which is held only at the end and thereby has a tendency to jam. The canister-shaped armature piston needs to have a comparatively large distance between it and the core part guiding it, in order to create a gap for passage of the liquid, whereby the magnetic power suffers and impaired liquid flow conditions ensue. The pump is designed for a specific swept volume and must be modified as a whole if a different volume is to be delivered. The delivery capacity is limited by the liquid gap, which is provided between the armature piston and the core flange and which restricts the passage of the liquid. At the same time the liquid gap in relation to the armature adversely affects the utilization of the field generated by the coil.

DE 103 60 706 A1 shows a solenoid-actuated check valve, comprising a closing element in the form of a ball and a valve seat formed in a seat body. The seat body is enclosed by an annular solenoid, which encloses the valve seat and part of the closing element, and when energized magnetically draws the closing element into the valve seat. The valve seat is embodied as a spherical segment having a radius of curvature corresponding to the radius of curvature of the closing element. An annular recess, which is filled by an elastomer seal, is provided in the valve seat, wherein the elastomer seal causes sealing with the closing element. A further annular elastomer area is provided in an extension of the valve seat, and comes into contact with the closing element when the solenoid is actuated. One disadvantage is the additional electrical supply required for actuation of the check valve. The known valve is furthermore not suited to installation in a solenoid-actuated pump, since the magnetic fields would interfere with one another.

BRIEF SUMMARY OF THE INVENTION

The invention provides a reciprocating piston pump which is inexpensive to produce and to operate.

The invention further provides a reciprocating piston pump which is reliable in use.

The invention still further provides a reciprocating piston pump having reduced sound emission.

The invention further provides a reciprocating piston pump having a reduced leakage.

The invention yet further provides a reciprocating piston pump having reduced number of parts.

The invention also provides a reciprocating piston pump that is easy to assemble.

A reciprocating piston pump for delivering a liquid according to a preferred embodiment of the invention comprises a solenoid with an actuator and an outlet port, wherein a check valve with a seat body is assigned to the outlet port for keeping a return flow of the liquid out of the reciprocating piston pump, wherein the seat body bears an impact damping face at a front face facing away from a valve seat of the check valve, and wherein the valve seat of the check valve and the impact damping face are made from the same elastomer material.

A reciprocating piston pump for delivering a liquid according to a second preferred embodiment of the invention comprises a solenoid with an actuator and an outlet port, wherein a check valve with a seat body is assigned to the outlet port for keeping a return flow of the liquid out of the reciprocating piston pump, wherein the seat body is covered at least partially by an elastomer material on an outer surface of the seat body, and wherein the elastomer material is attached to the seat body by means of one of scorching and injection molding.

A reciprocating piston pump for delivering a liquid according to a third preferred embodiment of the invention comprises a solenoid with an actuator, an outlet port, and a metering cylinder having a guide bore, wherein a check valve with a seat body is assigned to the outlet port for keeping a return flow of the liquid out of a pump chamber, wherein the guide bore guides a part of the actuator and is arranged upstream the check valve, wherein the seat body comprises an impact damping face, the impact damping face facing the metering cylinder and having a diameter exceeding the diameter of the guide bore, and wherein the impact damping face is fixedly attached to the seat body.

A reciprocating piston pump for delivering a liquid according to a fourth preferred embodiment of the invention comprises a solenoid with an actuator, an outlet port, and a metering cylinder having a guide bore, wherein a check valve comprising a closing element and a seat body is assigned to the outlet port for keeping a return flow of the liquid out of a pump chamber, wherein the guide bore guides a part of the actuator and is arranged upstream the check valve, wherein the seat body comprises an impact damping face, the impact damping face facing the actuator, and wherein the seat body is substantially completely received in a portion of the metering cylinder such that the closing element protrudes into the metering cylinder when the check valve is shut.

The small number of parts makes the reciprocating piston pump according to the invention easy to assemble. The small number of sealing points serves largely to prevent leakages.

According to one aspect of the invention, the reciprocating piston pump comprises a solenoid with an actuator and an outlet port, wherein a check valve having a valve seat formed on a seat body is assigned to the outlet port. The valve seat is facing away from the delivery chamber and is designed to receive a closing element or valve member biased towards the valve seat. An impact damping face is provided at an end face of the seat body facing away from the valve seat. This advantageously makes it possible to use a single component, which simultaneously comprises the valve seat and the impact damping face. The impact damping face is intended to come into contact with an end face of the actuator, generally a piston rod, which is connected to an armature piston of the actuator. The impact damping face serves to reduce a noise when struck by the end face of the actuator, whilst the damping furthermore prevents the vibrations being introduced into the reciprocating pump embodied as a solenoid-operated pump. Finally it is ensured that even with a slight angularity of the end face a full swept volume can be expelled, in that the impact damping face yields slightly. The impact damping face prevents premature closing and mechanical damage to the components of the reciprocating piston pump.

The valve seat of the check valve and the impact damping face are preferably formed from the same elastomer material. This can either be done by producing the seat body from one uniform elastomer material or by at least partially injection molding of the seat body, which for example can be made of steel or another metallic material, with an elastomer material. In this way the areas of the seat body particularly subjected to stresses can be of resilient design, so that noise generated by impacts or the like is prevented.

The seat body may be entirely formed from an elastomer material, in this case suitably having a rigidity sufficient to ensure that it is not distorted under the stresses occurring.

According to a preferred embodiment, the impact damping face may be formed as an inlet received by the seat body, wherein the inlet advantageously is not only axially but also radially enclosed by the seat body. However, the impact damping face is preferably attached by means of material regions of the elastomer material to other circumferential regions of the seat body, for example with the seat body's essentially cylindrical circumferential surface of the elastomer material, or for example with regions which are provided in the preferably cone shaped or dome shaped valve seat.

The impact damping face is preferably fixed to the seat body by positive interlock, force closure and/or a cohesive material joint. This ensures that the impact damping face does not drift within the delivery chamber, or cannot impair the working stroke of the actuator through awkward positioning of the reciprocating piston pump. This further ensures that guaranteed impact damping is afforded simply by assembly of the pump, and that there is no need for intricate positioning of a separate impact damping part in the delivery chamber. The impact damping face is advantageously dimensioned in such a way that it is at least as large as the guide bore of a metering cylinder guiding the end face of the actuator, in particular a piston rod. If the impact damping face is situated on the side facing away from the valve seat, but having at least face sections that cover a larger annular area of the seat body, it is also possible to use different guide bore diameters and hence different metering cylinders, without for this purpose having to separately adapt the impact faces to the chosen diameter.

Advantageously, the valve seat of the seat body is formed from an elastomer material. The elastomer material is suitably scorched onto the seat body, so that a permanent connection is created. It is possible for sections of the valve seat to be joined to other peripheral areas of the seat body, in order to thereby achieve additional support through positive interlock. In the area of its at least approximately cylindrical circumferential surface, the seat body is likewise at least partially enclosed by an elastomer material, the elastomer material here too may be scorched on. This casing achieves an especially reliable seating in the area accommodating the seat body, and further seals off from the liquid. This makes it possible to dispense with the provision of a separate seal, particularly where the casing comprises at least one and preferably more than one radially outward-facing sealing beads which create a seal with the housing part enclosing the seat body in the nature of a labyrinth seal.

The actuator suitably comprises a piston rod, which is fixed, for example, to an armature piston of the actuator, and which, with its end facing away from the armature piston, is circumferentially accommodated to freely move axially in a guide bore of the metering cylinder or in a comparable radial guide. The metering cylinder or the guide bushing at the end herein comprises a radial extension, which defines a shoulder and which circumferentially supports the component in a part of the reciprocating piston pump, suitably in a core part or a yoke. It is also possible to accommodate the extensions, which are preferably embodied as rotationally symmetrical shoulders, in another part, which defines a boundary of the delivery chamber of the reciprocating piston pump, for example the inner wall of a coil carrier carrying a coil. It is likewise possible to support one end of the metering cylinder radially against a first part and the other end against another part. With one end face the shoulder remote from the actuator preferably also serves as an axial abutment face, which is supported against the rear side of a valve seat of a check valve, which seals off the outlet port to prevent a return flow into the delivery chamber. The metering cylinder is suitably held by positive locking or force closure, so that it cannot perform a relative movement in the delivery chamber. At the end face the shoulder of the metering cylinder is preferably supported against an abutment in the core part of the solenoid, which may also be formed by a seat body of a valve seat. The abutment preferably forms a sealed contact face with the guide bore of the metering cylinder guiding the piston rod.

A check valve is suitably arranged in the outlet port and the check valve is designed to open in the delivery direction of the liquid to be delivered. The check valve prevents the liquid to be delivered running back into the pump chamber.

A spring preferably biases the actuator towards the inlet port, so that when the solenoid is switched off the actuator is carried into its starting position and the zero closure is closed, in order to prevent an uncontrolled penetration of the liquid to be delivered into the pump chamber.

The reciprocating piston pump for delivering a liquid comprises a solenoid with a actuator, wherein the actuator comprises an armature piston and a piston rod. The piston rod and a guiding member such as a metering cylinder which encloses the piston rod at least partially radially commonly define a swept volume, wherein—with an otherwise unmodified build up of the reciprocating piston pump—different swept volumes can be set up by inserting different pairs of guiding members and piston rods.

The reciprocating piston pump for delivering a liquid comprises a solenoid with a magnetic actuator, and a metering cylinder having a guide bore guiding a part of the actuator, wherein a seat body with a valve seat facing away from the actuator is accommodated in a mounting of the metering cylinder remote from the actuator. The seat body is hereby reliably connected to the metering cylinder and can be built and reliably fitted as a common standard component, even as a prefabricated unit. At the same time the delivery chamber and hence the pump is kept short and the reduction in the number of parts makes it inexpensive to produce. In particular, the same seat body may be inserted into different metering cylinders, which due to the variation in the diameter of their guide bore and the position of the radial connecting bores intended for supplying the liquid define different swept volumes, each with an actuator adapted to suit the dimensions. At the same time it is also possible to select and use that seat body, in each case adapted to the liquid to be delivered, which according to the requirements is also gas-tight or suited for the discharge of sticky media.

The valve seat is suitably accommodated inside the mounting in the metering cylinder. As a result axial loads of the metering cylinder are only transmitted a short distance over the valve seat, if at all, and are instead absorbed by the metering cylinder. This advantageously allows the valve seat to be lined at more than one axial end face with a thicker layer of elastomer material, which preferably at the same time provides sealing between the delivery chamber and the outlet port, whilst liquid return flow is prevented by the closing element interacting with the valve seat. Accommodating the valve body in the metering cylinder means that the thicker layer of elastomer material is isolated from axial pulses thereof, which can occur due to a spring braced against the metering cylinder or which may derive from the pulsating armature, and which would otherwise introduce an excessive deformation and hence a play into the pump. The very small amount of play also means that the armature can be used as a valve member sealing off the delivery chamber from inside.

The seat body preferably has a casing of an elastomer material, which encloses its outer circumferential surface and is elastically tensioned and sealed at the same time against the inner circumference of the mounting of the metering cylinder, which is suitably formed by a hollow cylindrical, axial extension of the external flange of the metering cylinder. The seal is furthermore maintained even under the thermal expansion that can easily occur due to heating in operation of the pump, since the elastomer material flexibly adjusts itself. The valve seat can moreover easily be fitted by insertion and the elastomer material is deformed to adjust to the given circumference. Leaks usually occuring in metal contact faces are thereby avoided and it is not necessary to subject the parts to heat treatment in order to insert them into one another as a press-fit. An annular projection of the seat body composed of elastomer material suitably protrudes beyond the end face of the mounting facing away from the actuator, and in fitting into a chamber is compressed and deformed, forming a ring seal, which encloses an entrance to the outlet port. This reliably seals off the chamber accommodating the metering cylinder from the outlet port. The guide bore is also sealed off from the chamber, thereby avoiding any slip of the liquid to be delivered.

The seat body suitably has a larger radial diameter than the guide bore of the metering cylinder and a smaller radial diameter than the metering cylinder. This ensures that when the closing element under spring tension impacts against the valve seat, the valve body is always pressed against a protruding edge of the metering cylinder forming an abutment. It has to be understood that the spring force of the spring acting on the actuator is greater than that of the valve spring; in order to prevent axial slipping of the metering cylinder this is preferably axially secured in the chamber of the core part, for example by force fitting.

At its end face facing towards the guide bore in the metering cylinder the seat body preferably has an impact damping face, obviating the need to insert a separate damping strip into the guide bore. The impact damping face may here have an annular groove, which is aligned at least approximately with the guide bore and thereby supports the deformation of the impact damping face when struck by the actuator, generally the free end face of a piston rod. Since the same seat body can be used in different metering cylinders, the annular groove may also run concentrically with the guide bore.

Further advantages and developments of the invention are set forth in the following description and in the dependent claims.

The invention will be explained in more detail below on the basis of preferred exemplary embodiments of the invention and with reference to the drawings attached, in which:

DETAILED DESCRIPTION OF THE INVENTION

Figure 1:
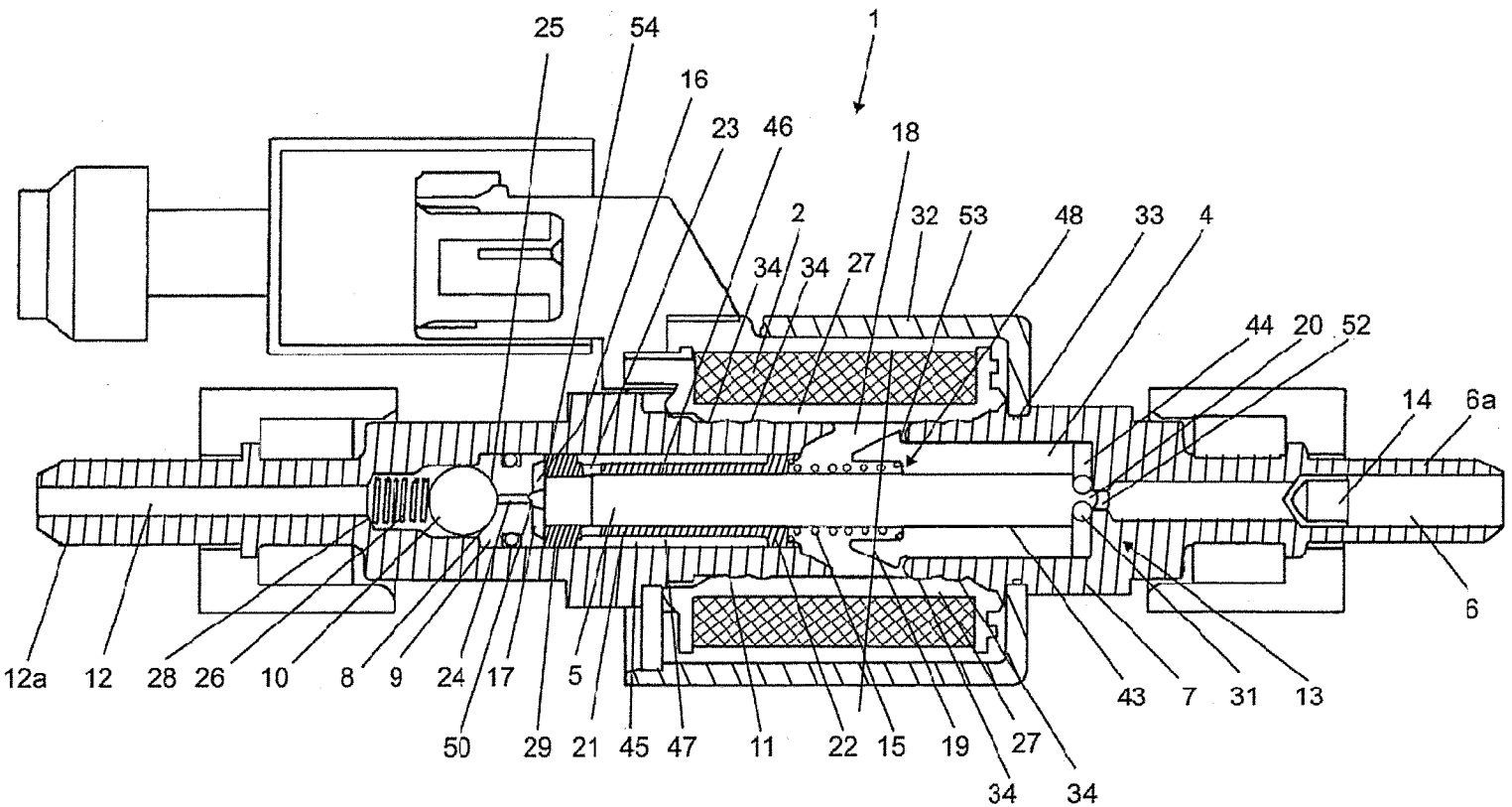
FIG. 1 shows a longitudinal section through a first preferred exemplary embodiment of a reciprocating piston pump.

The reciprocating piston pump 1 shown in FIG. 1 is embodied as a solenoid-operated injection pump and comprises a cup- or canister-shaped housing 32, in which a inlet-side opening 33 is provided. Arranged in the housing 32 is a coil carrier 27 in the form of a hollow cylinder, enclosing an internal chamber 18, which forms a delivery chamber, the coil carrier carrying a coil 2 and forming part of a solenoid.

A core flange 7 which, in a hollow cylindrical section defines a first chamber 44, which is at least partially enclosed by the coil 2, is inserted into the opening 33 and into the internal chamber 18. On its outer circumferential surface the hollow cylindrical section has multiple annular prominences 34, which serve to wedge it against an internal face of the coil carrier 27 and to hold it at least liquid-tight. Adjoining the hollow cylindrical section of the core flange 7 is an inlet port 6, wherein a connection piece 6*a* is integrally formed with the inlet port 6 and the core flange 7.

At an end opposite the internal camber of the coil carrier 27 the core flange 7 has the axially arranged inlet port 6, which opens into an internal chamber of the core flange 7. The inlet port 6 is arranged coaxially with the first chamber 44 and has a smaller diameter than the first chamber 44, wherein a restriction 52, which is yet smaller than the diameter of the inlet port 6, is provided in the transitional area from the inlet port 6 to the first chamber 44. The transition from the restriction 52 to the first chamber 44 defines a zero closure 13, which defines the delivery chamber on the inlet side. It is possible to close this zero closure 13 with an actuator of the solenoid-operated pump, so that a metal-to-metal seal is formed.

A filter 14, which is externally accessible and which can be replaced as necessary, is arranged in the inlet port 6 at a distance from the restriction 52. The filter 14 is of cylindrical design and has a taper at an end face situated opposite the inlet opening of the inlet port 6.

A core part 11, which is likewise wedged against an internal face of the coil carrier 27 by outward-facing annular prominences 34 and held at least liquid-tight, is inserted into the coil carrier 27 from the side opposite the core flange 7. The core part 11 has a second cylindrical chamber 45, which is partially still enclosed by the coil 2 and which in the direction of the core flange 7 has an open end on the inner side, which widens towards a funnel-shaped end edge. At its end remote from the inside end, the second chamber has an annular step 40, against which parts, yet to be explained in detail below, are supported, and further on two tapered sections 41 and 42, the outermost 41 of which opens into an outlet port 12, forming a further annular shoulder 28. The outlet port 12 is formed in the same core part 11, so that the connection piece 12*a* together with the outlet port 12 and the core part 11 forms an integral component. The outlet port 12 has a smaller diameter than the second chamber 45 and the same diameter as the inlet port 6.

The core flange 7 and the core part 11 are each of rotationally symmetrical design, which makes them easier to manufacture, and are formed so that they are substantially hollow cylindrical. A connection piece 6*a* for the inlet port 6 and 12*a* for the outlet port 12 are in each case integrally formed with the core flange 7 and the core part 11 respectively.

The core flange 7 and the core part 11 axially enclose a delivery chamber 18, which is connected to the inlet port 6 and the outlet port 12. An actuator which, when a current is passed through the coil 2, is displaced axially towards the core part 11 due to the magnetic field, is inserted into the delivery chamber 18. For this purpose the actuator comprises a magnetizable armature or armature piston 4, which is adjustably connected to a piston rod 5 by way of a central screw fastening 43, so that their axial spacing is adjustable through rotation of the two parts 4, 5 relative to one another about their common axis. The first chamber 44 of the core flange 7 axially guides the armature piston 4, the armature piston 4 being biased towards the inlet port 6 by a spring 15 in the form of a helical coil spring. A collar section 53 of the armature piston 4, which protrudes beyond the circumferential surface of the first chamber 44, forms a limit stop for the displacement travel under the force of the spring 15. Emerging from the collar section 53, the armature piston 4 has an annular cone section 19 adapted to the funnel-shaped end edge of the core part 11. The spring 15 is braced against an abutment section 48 of the armature piston 4 enclosing the annular cone section 19 and has the piston rod 5 passing axially through it. The spring 15 may obviously also be braced against a corresponding abutment section of the piston rod 7 connected to the armature piston 4, in order to bias the armature piston 4 towards the inlet port 6.

A valve spring 26 embodied as a helical coil spring, which biases a closing element 10 in the form of a ball towards a valve seat 8 of a seat body 9, yet to be explained in detail, is braced against the further annular shoulder 28 of the second chamber 45. The seat body 9 is inserted with its valve seat 8 facing the ball 10 into the second chamber 45, a metering cylinder 21 likewise inserted into the second chamber 45 being supported against its rear side. The metering cylinder 21 has a first, external outer flange 29 with an end face 49 and a second internal outer flange 22, both having a radial outer periphery 54, which is supported against an inner wall of the second chamber 45 of the core part 11. It is possible to caulk the two outer flanges 22, 29 against the chamber, however herein the metering cylinder 21 is axially fixed by the end of the spring 15, which is situated opposite the armature and which by way of the metering cylinder 21 also secures the seat body 9. These two parts can thereby be produced without any allowance and easily inserted into the chamber 45.

The metering cylinder 21 has a continuous guide bore 46, which also passes through the two outer flanges 22, 29. Between the first outer flange 29 and the second outer flange 22 two bores 23, running radially in relation to the guide bore 46, are provided opposite one another, which create a fluid connection between the guide bore 46 and an annular space 47, which is provided between the outer flanges 22, 29 in the chamber 45. The guide bore 46 is intended for receiving and axially guiding the free end of the piston rod 5 remote from the armature piston 4. Here the free end of the piston rod 5 is approximately arranged so that with no current passing through the coil 2 at least a part of the radial bores 23 is exposed.

When a current is passed through the coil 2, the armature piston 4 with the piston rod 5 performs a working stroke towards the seat body 9, and the swept volume, which is contained between the radial bores 23 and the end face 49 in the guide bore 46, is expelled.

It will be seen that it is possible to provide different metering cylinders having a different diameter of the guide bore 46 and/or a different positioning of the radial bores 23 but the same dimensions of the outer flanges 22, 29, which can all be inserted into the chamber 45 of the core part 11. Here only the piston rod 5 has to be adapted to the modified dimensions of the respective metering cylinder 21, it being possible to adjust the stroke travel of the actuator 4, 5 through a corresponding adjustment of the number of turns of the coil 2. The reciprocating piston pump 1 can thereby be combined with a multiplicity of different pairings of metering cylinders and piston rods, whilst the construction of the reciprocating piston pump 1 remains otherwise unchanged, so that a cost-effective and easily assembled module is created for reciprocating piston pumps of different output. It has to be understood that the piston rod will then have one or more steps between its screw fastening—of unmodified diameter—and its free end, in order to match the dimension of the guide bore 46.

At an end facing the inlet port 6 and remote from the metering cylinder 21 the piston rod 5 with an extension 20 protrudes beyond the end of the armature piston 4, an O-ring 31 made from an elastomer material being arranged on a neck of the extension 20. When the armature piston 4 is displaced by the spring 15, the extension 20 penetrates into the restriction 52 and closes this fluid-tightly, whilst the O-ring 31 ensures damping. It is possible to provide the extension 20 on the armature piston 4 itself or on a rod section separate from the piston rod 5, so that without modifying the extension 20 the piston rod 5 can be axially rotated or entirely replaced in order to adjust the distance between it and the armature piston 4.

Figure 2:
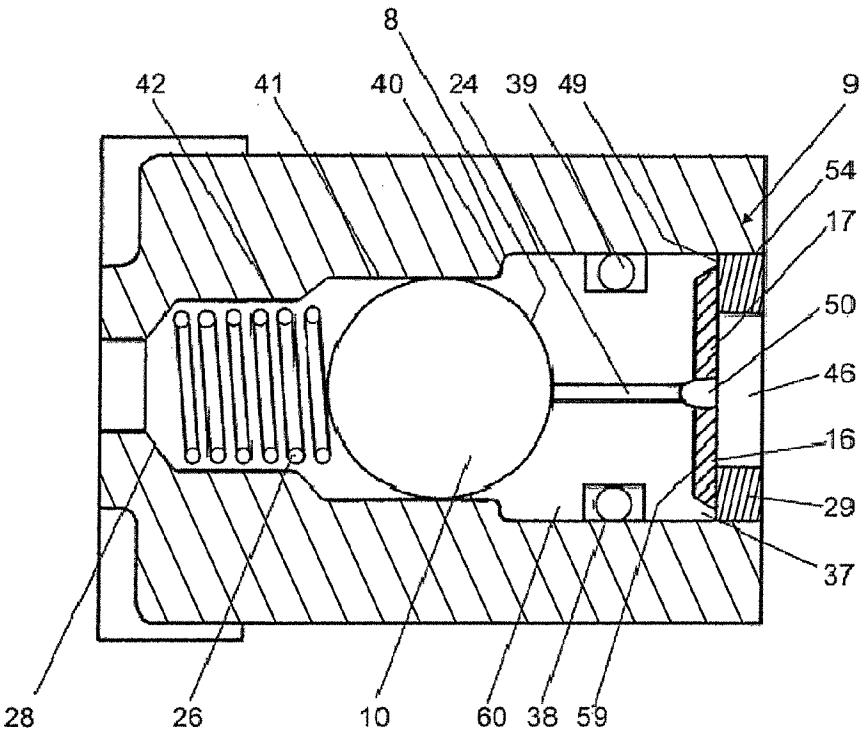
FIG. 2 shows an enlarged representation of the seat body of the check valve of the reciprocating piston pump in FIG. 1.

The seat body 9, which is shown enlarged in FIG. 2, is embodied as a steel part and has a substantially cylindrical shape, with a central duct 24 passing through it. The valve seat 8 facing the closing element 10 has a virtually semi-spherical recess 25, which corresponding to a spherical segment or a ball cup is adapted to the contour of the closing element 10 embodied as a ball, and in the center of which recess the duct 24 opens out. The end of the duct 24 facing away from the recess 25 opens out in a bore 50 provided in an impact damping face 16 of the seat body 9.

With the closing element in the form of a ball 10 the recess 25 defines not just a linear contact but moreover a planar, in this case a striated, contact; in other words: instead of a punctual line the contact occurs along an area which is extended on both sides of a line and which defines a strip. This strip is defined by two closed, reciprocally spaced lines over the surface of the ball 10, corresponding to which is a corresponding strip on the surface of the recess 25. One can see that the ball 10 nevertheless has an axial space between it and the orifice of the duct 24. The recess 25 has a curvature matching a curvature of the closing element 10, wherein the valve spring 26 braced against the annular step 28 presses the closing element 10 towards the recess 25.

The impact damping face 16 is provided in a cylindrical depression 59 enclosed by an annular area 37 of the seat body 9 at an end face of the seat body 9 situated opposite the recess 25. The depression 59 axially and radially holds the elastomer body 17 forming the impact damping face 16, the opposing sides being adhesively bonded or fixed in relation to one another by other means. One can see that the diameter of the elastomer body 17 is greater than the guide bore 46, so that the impact damping face 16 is additionally covered at the edges by the end face 49 of the external outer flange 29. The end face 49 is moreover supported on the outer, inflexible annular area 37 of the seat body 9 enclosing the elastomer body 17. The impact damping face 16 exposed by the guide bore 46 is thereby securely and reliably held and does not have to be inserted separately into the guide bore 46.

An annular groove 38, in which a sealing ring 39 is inserted, is provided in a circumferential surface of the seat body 9. The sealing ring 39 seals off the seat body 9 fluid-tightly from the inside wall of the guide bore 46.

The reciprocating piston pump now functions as follows:

When a current passes through the solenoid via the coil 2, the armature piston 4 is attracted towards the core part 11 and the spring 15 is tensioned. At the same time the piston rod 5 with the armature piston 4 moves in the direction of the outlet port 12 and after passing over the radial bores 23 displaces the liquid to be delivered through the check valve 9, 10 into the outlet port 12. When the current passing through the coil 2 is terminated, the spring 15 presses the actuator comprising the armature piston 4 and the piston rod 5 back into its starting position, and the O-ring 31 closes the restriction 52. During the stroke the swept volume expelled continues to flow out of the inlet port 12.

Figure 3:
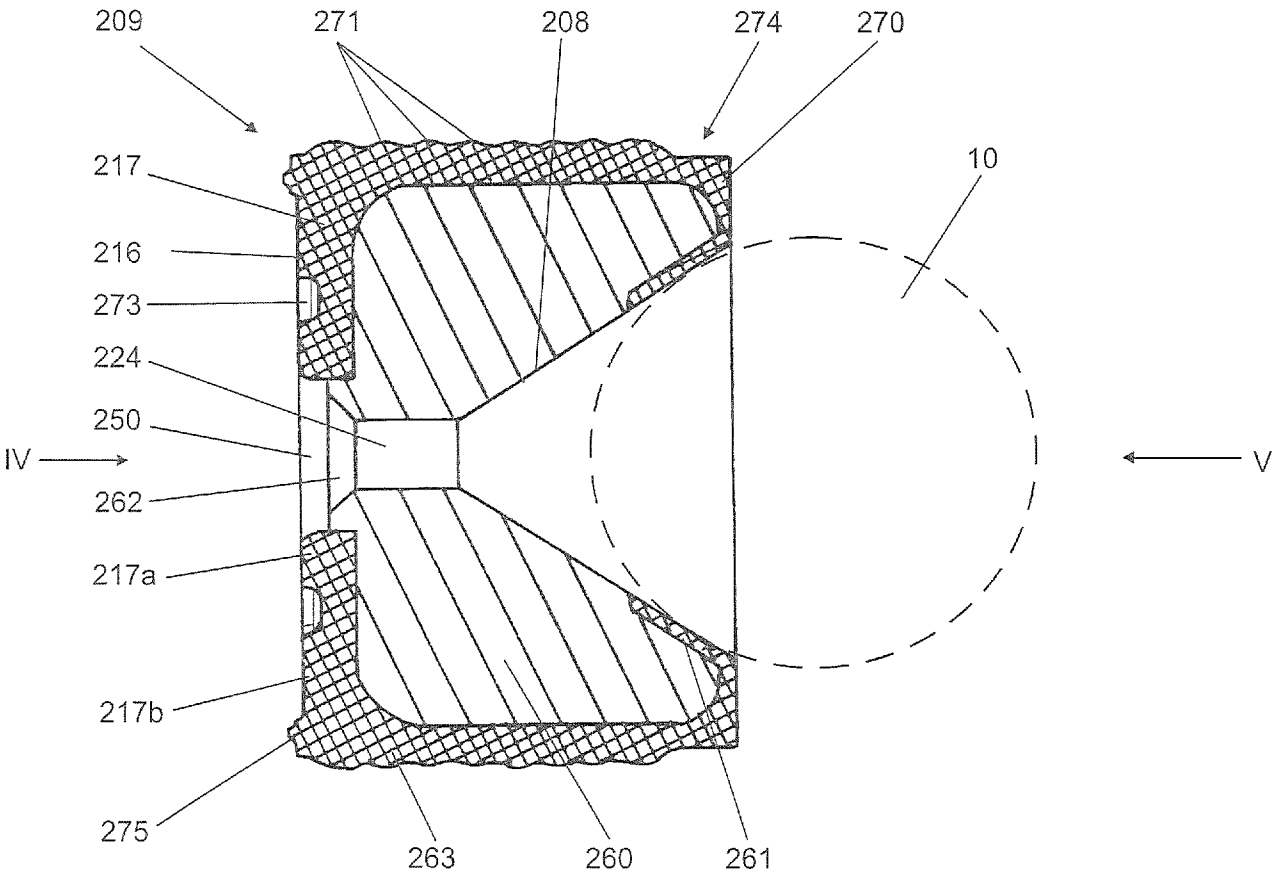
FIG. 3 shows a longitudinal section of an alternative embodiment of a seat body for a check valve for the reciprocating piston pump according to FIG. 1.
Figure 4:
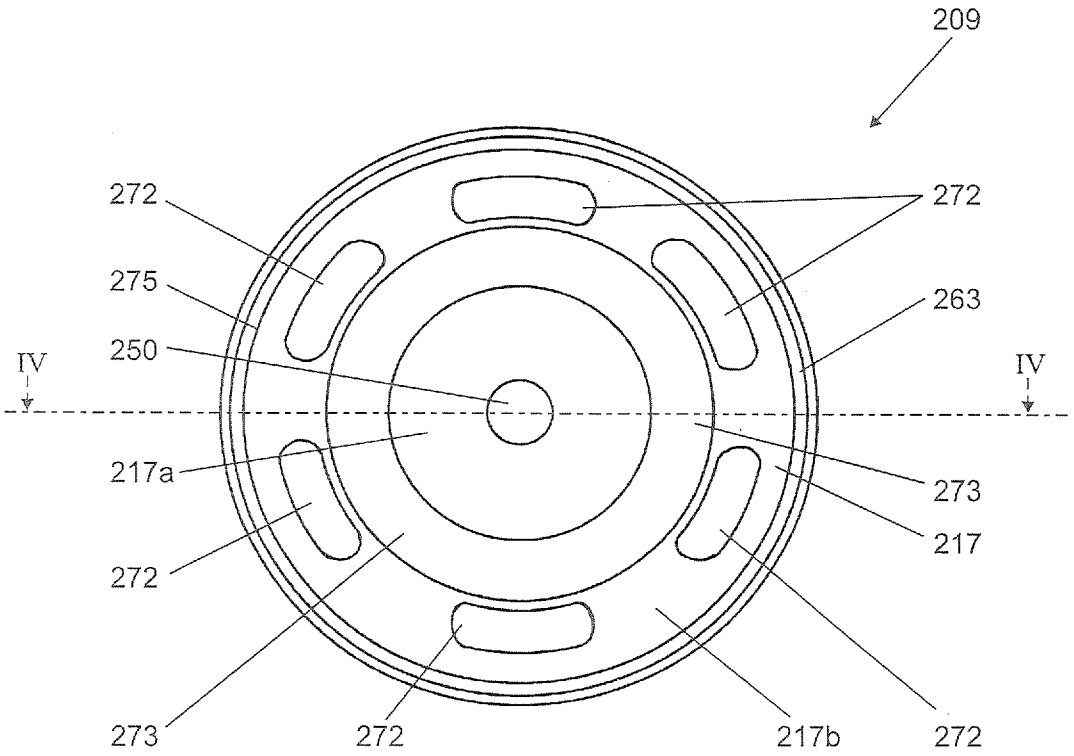
FIG. 4 shows a back view of the seat body according to FIG. 3.
Figure 5:
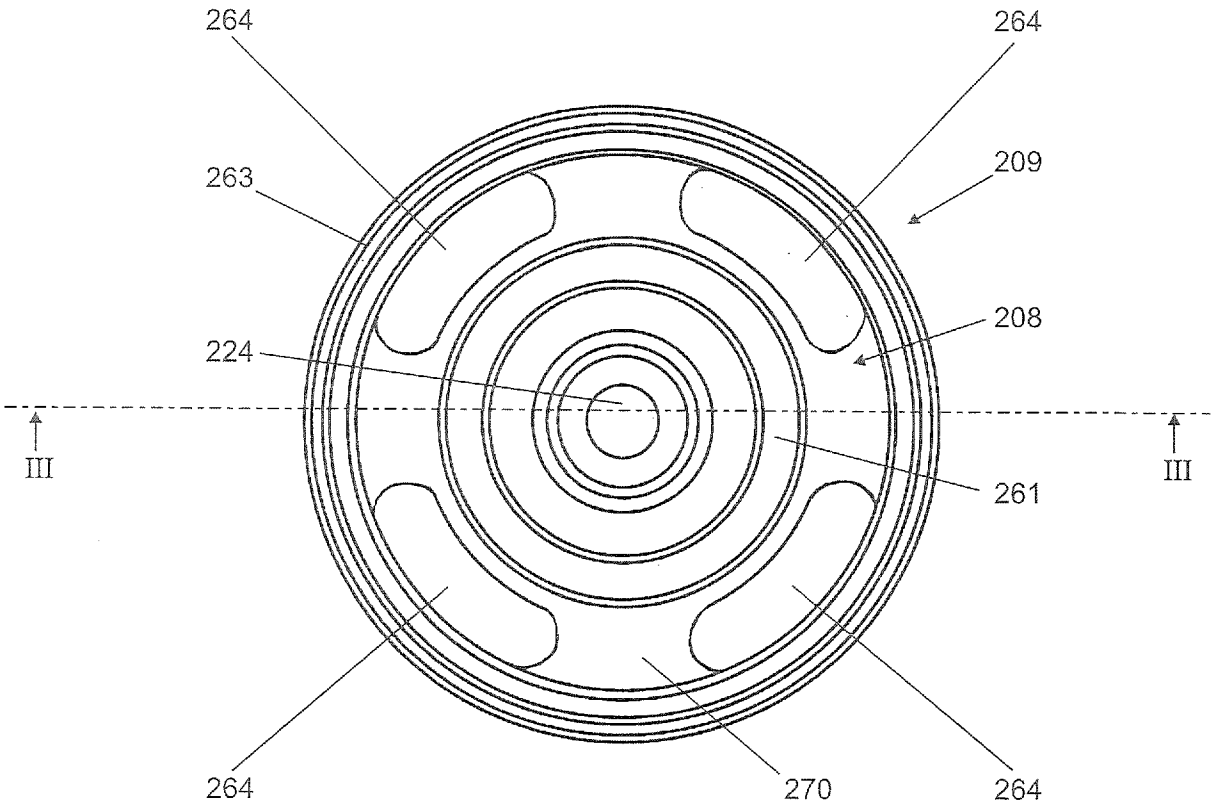
FIG. 5 shows a front view of the seat body according to FIG. 3.

FIGS. 3 to 5 show a preferred alternative embodiment of a seat body 209 which can be placed within the reciprocating piston pump 1 according to FIG. 1 instead of the seat body 9 shown in FIG. 1. The same—respectively the reference numerals incremented by 200—show the same—respectively structurally comparable—elements as the seat body 9 of FIGS. 1 and 2.

The seat body 209 comprises an essentially cylindrical base body 260 made of steel, which base body has a funnel-shaped valve seat 208. The valve seat 208 is essentially cone shaped and reduces its inner diameter from the end face to the central channel 224.

The valve seat 208 shows, at a side facing towards the closing element 10 at a surface region assigned to a closing element 10, at an inlet region 261 made of an elastomer, wherein the inlet region 261 is shaped like a blunt hollow cone and wherein the inner diameter of the inlet region 261 is aligned with the inner diameter of the valve seat 208. The inlet region 261 is delimited at its inner surface by the metallic valve seat 208, while the inlet region 261 merges at its outer surface into a front region 270 made of the same elastomer material. The front region 270, as shown in FIG. 5, is traversed with four burled shaped, metallic extensions 264 in the form of rounded ring-segments of the base body 260 which stabilize the elastomer and which secure it against transverse warping.

The front region 270 merges into an outer region 263 of the same elastomer radially enclosing the base body 260. The outer region 263 has at its outer circumference a plurality of protruding and rounded rips 271 which improve a sealing and a solid hold within a corresponding chamber. In a front side circumferential region the mantel region 263 is designed with a female face 274 which eases the insertion into a chamber.

The through-bore 224 opens into a funnel-shaped extension 262, whose diameter increases in the direction away from the valve seat 208, and leads into a bore 250 in an impact damping region 217 made of the elastomer. The impact damping region 217 defines an impact damping face 216, which covers in particular the inner ring **217*a* and an outer ring area 217*b* of the impact damping region 217. As can be seen particularly in FIG. 4, the outer ring area 217*b* is interspersed by six metallic protrusions 272 of the base body 260 that protrude as rounded strip-circular segments and stabilize the impact damping region 217 and at the same time define an end stop on which for example a metering cylinder can be definedly supported. It is possible to also partially cover the projections 272 with elastomeric material. The inner ring 217*a* and the outer ring area 217*b* are separated by a circular groove provided in the elastomer material 273 which improves the deformation capability of the impact damping face 216 and thus improves the dampening of an impinging piston rod. In its outer edge portion the impact damping region 217 features a projection 275** which acts in the manner of a sealing lip.

The elastomer material is injection molded onto the base body 260. It is also possible to scorche the corresponding elastomer areas.

Figure 6:
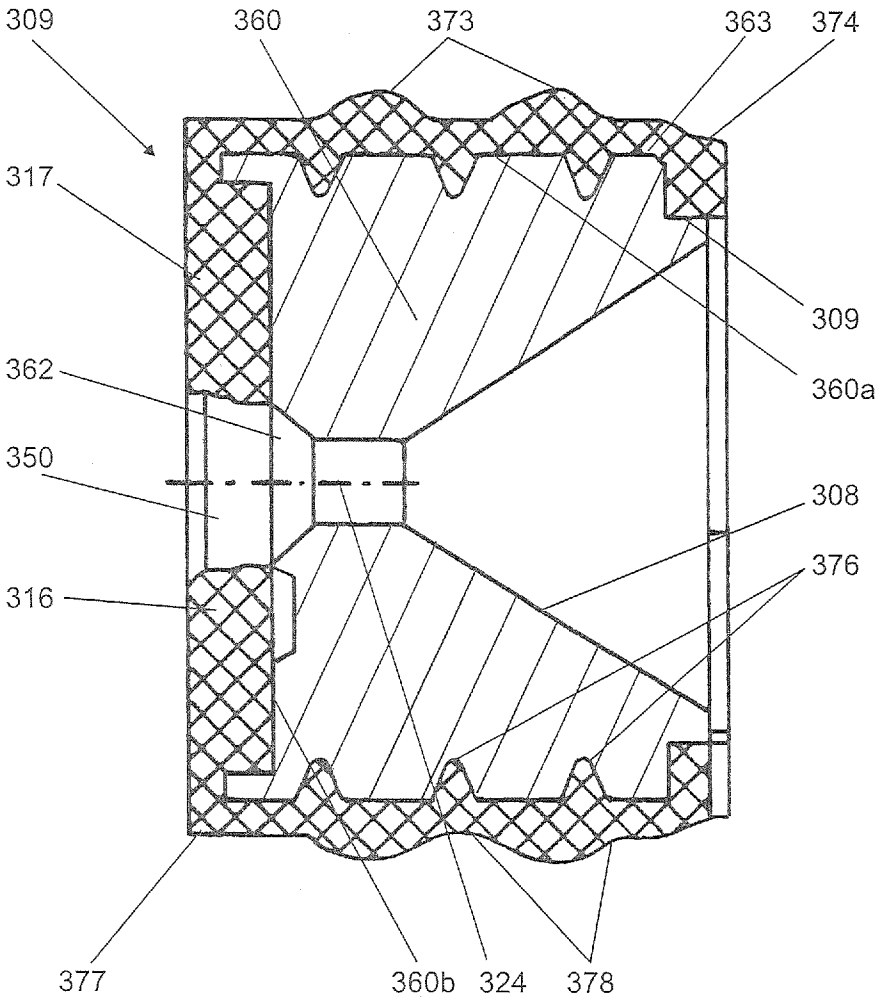
FIG. 6 shows a longitudinal section of another alternative embodiment of a seat body for a check valve for the reciprocating piston pump according to FIG. 1.

FIG. 6 shows another preferred alternative embodiment of a seat body 309 which can be used in the reciprocating piston pump 1 of FIG. 1 instead of the seat body 9 shown there. The same respectively the reference numerals incremented by 100 with respect to the previous embodiment show the same respectively structurally comparable elements as in FIG. 3 to 5.

The seat body 309 comprises an approximately cylindrical base body 360 made of steel with a conical valve seat 308 which is arranged on a front surface of the base body 360 and the diameter thereof decreasing in the direction of a through-bore 324. A funnel-shaped depression 362 follows to the through-hole 324, which leading into a bore 350 of an impact damping face 316.

The main body 360 shows on its outer surface 360*a* a plurality of circumferential ridge-cuts 376 which have an approximately triangular cross section. Furthermore, the base body 360 has on its front side 360*b* facing away from the valve seat 308 an annular outer edge 377.

The outersurface 360*a* and the front side 360*b* of the base body 360 are provided with an enclosing 363 made of an elastomer material which is vulcanized to the base body 360. It is also possible to injection mold the elastomer material. On the surface in contact with the outer surface 360*a* incisions 376 are penetrated by the elastomer material shaped as complementary edges 378 which improve the adhesion by a tight fit.

The enclosing 363 of the outer surface 360*a* creates an approximately cylindrical outer contour which forms two radially outwardly projecting, rounded sealing beads 373. The sealing beads 373 improve the grip and the sealing in a corresponding chamber receiving the seat body 309. In a front-side peripheral area the enclosing 363 is designed with a slightly conical stage 374 which facilitates the insertion into a chamber. To this end, the circumference of the base body 360 is formed at its front side with an annular inwardly directed notch 379. The stage 374 slightly protrudes axially over the front end of the main body 360 facing the valve seat and thus defines a damping and sealing section.

The front end 360*b* is formed by an elastomer region 317 of the enclosing 363 whose free end defines a flat impact damping face 316. In the elastomer region 317 the annular outer edge 377 of the base body 360 is enclosed as well. The impact damping face 316 annularly surrounds the bore 350.

Figure 7:
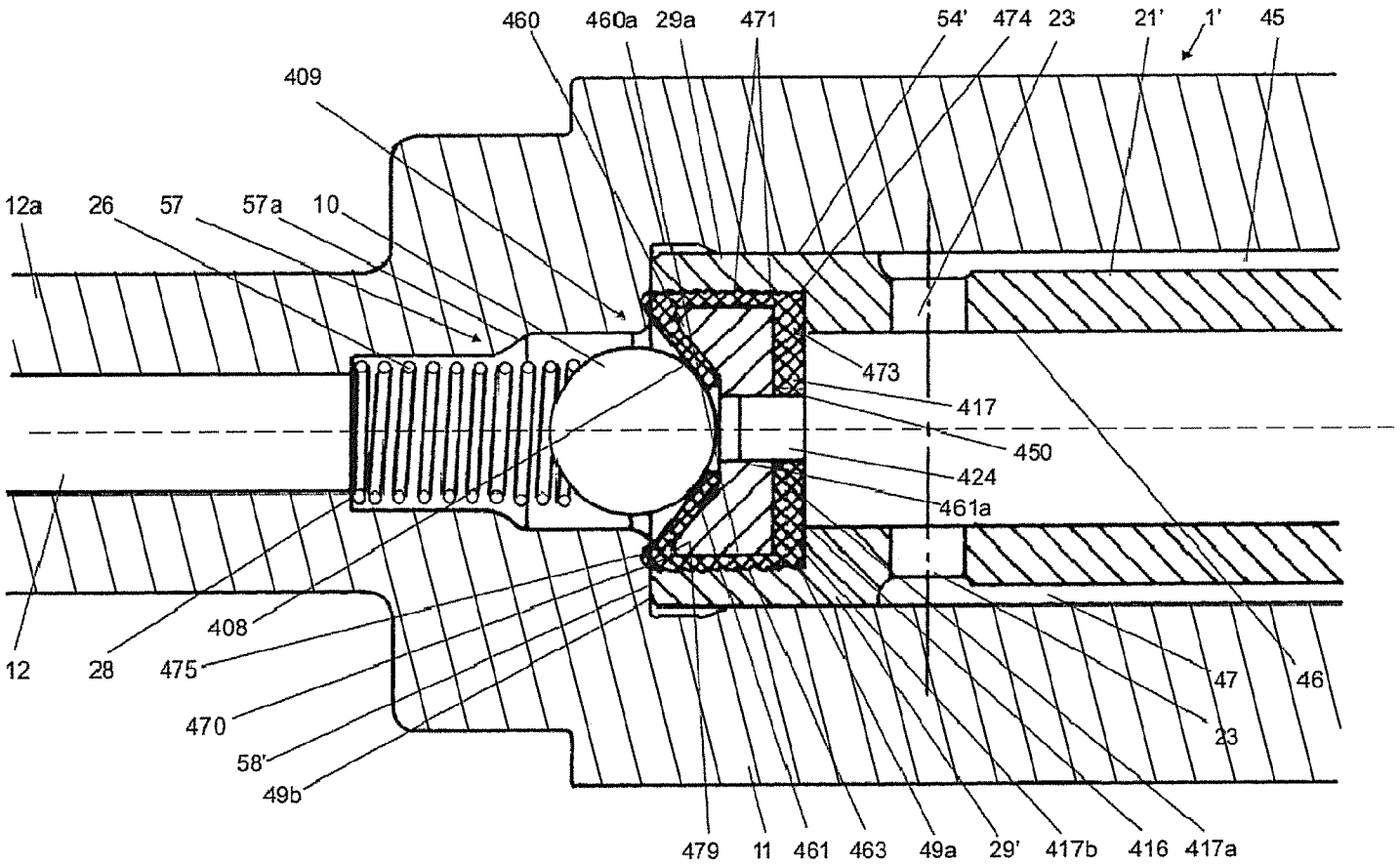
FIG. 7 shows a longitudinal section through a further alternative embodiment of a seat body for a check valve for a reciprocating piston pump modified compared to that in FIG. 1.

FIG. 7 shows a further preferred alternative embodiment of a seat body 409, which can be used in the reciprocating piston pump 1 in FIG. 1 instead of the seat body 9 shown there.

In the representation according to FIG. 7 the seat body 409 is shown enlarged in an installed position in a core part 11 of a reciprocating piston pump 1' which is integrally produced with an outlet connection 12*a* and which is otherwise of identical construction to the reciprocating piston pump 1 according to FIG. 1. It will be seen that in the reciprocating piston pump 1' the metering cylinder 21' with its external outer flange 29' is radially supported by its radial outer periphery 54' on the second chamber 45 of the core part 11, the outer flange 29' widening axially outwards, that is to say in the direction of the outlet port 12, in the manner of a hollow cylinder 29*a*. The hollow cylinder 29*a* encloses an internal annular step 49*a* of the end face of the metering cylinder 21' and itself has an annular end face 49*b*, which is supported against a base 58', in the form of an annular face, of the second chamber 45 formed in the core part 11. The base 58' encloses a passage area 57 of diminishing stepped cross section, which has a funnel-shaped step 57*a* and at an annular shoulder 28 opens into the outlet port 12.

At one end a valve spring 26 in the form of a helical coil spring is braced against the annular shoulder 28 and at the other end biases the closing element in the form of a ball 10 towards the seat body 409.

It will be appreciated that the modification shown allows the metering cylinder 29' to be braced by the end face of the hollow cylinder 29*a* against the base 58' and the circumferential surface of the second cylindrical chamber 45. The seat body 409 is inserted in the mounting 474 enclosed by the hollow cylinder 29*a* and formed in the metering cylinder 29'. The seat body 409 is larger than the duct cross section to the outlet port 12, which is enclosed by the base 58', so that the seat body 409 is held wedged between the base 58' and the annular step 49*a*. This creates a favorable design in which the seat body 409 is accommodated at the end face and circumferentially in the metering cylinder 29'.

The seat body 409 comprises an approximately cylindrical base body 460 made of steel and a casing 463 of an elastomer material, which may be either injected and/or scorched on. The seat body 409 comprises a tapered valve seat 408, which faces the ball 10 and which is arranged at one end face of the seat body 409, the diameter thereof diminishing in the direction of a through-bore 424. The through-bore 424 merges into a bore 450 of an elastomer area 417, the side of which remote from the valve seat 408 defines a plane impact damping face 416.

It will be seen that the seat body 409 in the area of the valve seat 408 on the tapered face of the base body 460 is equipped with a circumferential layer 461 of the elastomer material of the casing 463, which allows a planar contact with the ball 10 due to slight yielding in the area of contact, thereby also creating an improved sealing function to prevent the passage of gas as well as liquids. The layer 461 extends almost to the through-bore 424, a central disk-shaped recess 461*a* being enclosed by the internal edge of the layer 461, from the center of which the through-bore 424 then proceeds, forming a step. The internal edge is here formed concentrically with the through-bore 424.

The layer 461 merges into an end area 470 of the same elastomer, which runs substantially around the outermost annular edge 479 of the base body 460, where it is more thickly formed. In this case the casing in the area of the outermost annular edge 479 is formed in the manner of a projection 475, which close to the edge of the duct cross section to the outlet port 12 is enclosed by the base 58', and which acts in the manner of a sealing lip, and on tensioning of the metering cylinder 21' is pressed against the base 58' and—in contrast to what is indicated in the drawing—is deformed and thereby at the same time advantageously seals off the metering cylinder 21' and the second chamber 45 from the outlet port 12. It will be seen that in cross section the outermost annular edge 479 does not quite run to a tip.

The end area 470 merges into an elastomer casing, which covers the substantially plane circumferential surface 460*a* of the base body 460 and on the outside of which four projecting, circumferential, rounded ribs 471 are provided, which ensure a reliable grip in the hollow cylinder 29*a*, in opposition to which the seat body 409 is slightly over-dimensioned. The seat body 409 is forcibly inserted into the hollow cylinder 29*a* of the metering cylinder 21' by deforming the ribs 471 and together with this cylinder can be inserted into the second chamber 45 from the direction of the delivery chamber 18, once the spring 26 and ball 10 have first been introduced, wherein the projection 475 prior to fitting still protrudes beyond the end face 49*b*. It will be seen that no further seal is required in order to seal off the delivery chamber 18 from the outlet port 12, thereby creating an extremely simple, cost-effective and reliable construction.

The circumferential elastomer material of the seat body 409 merges into the elastomer area Which is remote from the valve seat 408 and which forms an impact damping area 417 for the piston rod 5, a rebounding step 274 or chamfer, which facilitates the introduction into the hollow cylinder 29*a*, during manufacture being formed onto its radial periphery in an end section of the elastomer material. The impact damping area 417 comprises an inner ring 417*a* and an outer ring area 417*b*, which are separated from one another by an annular groove 473. The annular groove 473 is aligned at least approximately with the guide bore 46 of the metering cylinder 21', so that the outer ring area 417*b* is substantially in contact with the inside annular step 49*a* of the end face of the metering cylinder 21', whilst the inner ring 417*a* has substantially the same cross section as the free end face of the piston rod 5, and supported, in particular, by the annular groove 473, damps an impact of the piston rod 5 under a slight elastic deformation. It will be seen that the central recess or bore 450 tapers slightly outwards towards the delivery chamber and is of a somewhat larger radial dimension than the through-bore 424 in the base body 460. This serves to ensure that elastomer material deformed in the impact damping does not constrict the passage.

Since the seat body 409 according to FIG. 7 is inserted into the metering cylinder 21', it has a smaller diameter than the other exemplary embodiments of seat bodies. It has to be understood that in the case of such an application these can be accordingly adapted in their design.

The seat body 409 may obviously also have burled, metal extensions or projections of the base body 460, as have been described with reference to the exemplary embodiment according to FIGS. 3 to 5 with the reference numerals 264 and 272. Reference is made in this context to the description relating to these.

It will be appreciated that the particular advantage of the embodiment according to FIG. 7 is the short overall space required, since the ball 10 penetrates even into the inside of the hollow cylinder 29*a* of the metering cylinder 21' and hence into the second chamber 45.

The invention has been described above with reference to exemplary embodiments in which a seat body is enclosed at least partially by an elastomer material. In principle any sufficiently flexible plastic having a suitable elasticity is feasible as elastomer material, correspondingly inert plastics being chosen in respect of potentially aggressive media.

The invention has been explained above on the basis of exemplary embodiments of a solenoid-operated reciprocating piston pump, the actuator 4, 5 of which is biased towards the inlet opening by a spring 15, and in which the actuator under the tensioning of the spring is axially moved by electromagnetic means, discharging a swept volume. It has to be understood that the actuator may be correspondingly biased by a spring towards the outlet opening, and under the tensioning of the spring is displaced by electromagnetic means axially away from the outlet opening, a swept volume thereafter being discharged as the spring relaxes.

What is claimed is:

1. A reciprocating piston pump for delivering a liquid, comprising a solenoid with an actuator, and an outlet port, wherein a check valve with a seat body is assigned to the outlet port for keeping a return flow of the liquid out of the reciprocating piston pump, wherein the seat body bears an impact damping face at a front face facing away from a valve seat of the check valve, wherein the valve seat of the check valve and the impact damping face are made from the same elastomer material, and wherein the impact damping face is separated into an inner ring area and an outer ring area by a circular groove provided in the elastomer material.

2. The reciprocating piston pump according to claim 1, wherein the seat body is made entirely from an elastomer material.

3. The reciprocating piston pump according to claim 1, wherein the impact damping face is fastened to the seat body to retain the impact damping face from loosening and to ensure that the impact damping face does not drift within the reciprocating piston pump.

4. The reciprocating piston pump according to claim 1, wherein the check valve is a ball check valve.

5. The reciprocating piston pump according to claim 1, wherein at least the valve seat is attached to the seat body by one of scorching and injection molding.

6. The reciprocating piston pump according to claim 1, wherein the seat body comprises an at least partial enclosure made from an elastomer material, and wherein the elastomer material is attached to a base body by means of one of scorching and injection molding.

7. The reciprocating piston pump according to claim 6, wherein the enclosure comprises at least one radially outwardly protruding sealing bead.

8. The reciprocating piston pump according to claim 1, wherein an outer diameter of the impact damping face is at least as large as a diameter of an end face of the actuator coming into contact with the impact damping face.

9. The reciprocating piston pump according to claim 1, wherein the reciprocating piston pump further comprises a metering cylinder having a guide bore, wherein the guide bore guides a part of the actuator, and wherein the seat body is received within a mounting of the metering cylinder facing away from the actuator.

10. The reciprocating piston pump according to claim 9, wherein the valve seat is located within the mounting.

11. The reciprocating piston pump according to claim 9, wherein an annular projection of the seat body composed of the elastomer material forms a ring seal which is sealing off the outlet port from a chamber accomodating the metering cylinder.

12. The reciprocating piston pump according to claim 9, wherein the seat body has a larger radial diameter than the guide bore of the metering cylinder and a smaller radial diameter than the metering cylinder.

13. The reciprocating piston pump according to claim 9, wherein the seat body has the impact dampening face at its end face facing the guide bore of the metering cylinder.

14. The reciprocating piston pump according to claim 9, wherein the impact dampening face comprises an annular groove which is aligned with the guide bore of the metering cylinder.

15. A reciprocating piston pump for delivering a liquid, comprising a solenoid with an actuator, an outlet port, and a metering cylinder having a guide bore, wherein a check valve with a seat body is assigned to the outlet port for keeping a return flow of the liquid out of a pump chamber, wherein the guide bore guides a part of the actuator and is arranged upstream the check valve, wherein the seat body comprises an impact damping face, the impact damping face facing the metering cylinder and having a diameter exceeding the diameter of the guide bore, wherein the impact damping face is fixedly attached to the seat body, and wherein a front face of the impact damping face is interspersed by metallic protrusions that support the metering cylinder.

16. The reciprocating piston pump according to claim 15, wherein a seal insulating the outlet port from a liquid chamber is a ring seal member axially protruding from and integrally configured with the seat body.

17. The reciprocating piston pump according to claim 15, wherein the outlet port is integrally formed with a core part and a connection piece.

18. The reciprocating piston pump according to claim 15, wherein an elastomer material is attached to the seat body using a method comprising a working process selected from the group consisting of scorching and injection molding.

19. The reciprocating piston pump according to claim 15, wherein the metering cylinder comprises a radial shoulder defining an abutment surface for the seat body and the impact damping face, and wherein the metering cylinder has a front end abutting axially against an outlet part.

20. The reciprocating piston pump according to claim 15, wherein the impact damping face is attached by means of material regions of the elastomer material to circumferential regions of the seat body.

21. The reciprocating piston pump according to claim 20, wherein the circumferential regions are sections of a cylindrical circumferential surface of the seat body.

22. The reciprocating piston pump according to claim 21, wherein the circumferential regions are connected to regions of the elastomer material provided in the valve seat.

* * * * *